US005989072A

United States Patent [19]

Hickox et al.

[11] Patent Number: 5,989,072

[45] Date of Patent: Nov. 23, 1999

[54] CONNECTION SYSTEM WITH TERMINAL/ CAVITY COMBINATION

[75] Inventors: Jeffrey Michael Hickox, Middlefield; Joseph Howard Gladd, Cortland, both of Ohio; Andrew Frank Rodondi, Sharpsville, Pa.

[73] Assignee: General Motors Corporation, Detroit, Mich.

[21] Appl. No.: 08/972,190

[22] Filed: Nov. 18, 1997

[51] Int. Cl.[6] ..... H01R 13/502

[52] U.S. Cl. ..... 439/701; 439/753

[58] Field of Search ..... 439/701, 594, 439/713, 578, 595, 752

[56] References Cited

U.S. PATENT DOCUMENTS

| | | | |
|---|---|---|---|
| 4,220,384 | 9/1980 | Clark et al. | 439/595 |
| 5,122,077 | 6/1992 | Maejima et al. | 439/398 |

OTHER PUBLICATIONS

R. Mroczkowski, Electronic Connector Handbook, McGraw–Hill, p. 6.4, 1998.

*Primary Examiner*—Paula Bradley
*Assistant Examiner*—Alexander Gilman
*Attorney, Agent, or Firm*—Cary W. Brooks; Patrick M. Griffin

[57] ABSTRACT

The invention includes an electrical connection system utilizing a terminal/cavity combination. The system includes a connector housing having a bay for receiving a plurality of the terminal/cavity combination units in a stacked relationship. The terminal/cavity combination unit includes a metal terminal, preferably having a tuning fork configuration, that is received in an electrically insulative carrier. The insulative carrier has a terminal cavity defined in part by two spaced apart side walls and a floor extending between the side walls for supporting the terminal. The carrier also includes a front wall having an opening for receiving a portion of a second terminal therethrough and so that the second terminal makes electrical contact with the terminal in the carrier. At least one indexing rail extends downwardly from a portion of the floor. Carriers can be stacked one on top of the other wherein the rail or rails are received between the two spaced apart walls of the carrier below. A plurality of terminal/cavity combination units in the stacked relationship are then inserted into the bay of the connector housing. Simple mating lock features on the terminal/cavity combination unit and the housing keep the units in place.

9 Claims, 3 Drawing Sheets

CONNECTION SYSTEM WITH TERMINAL/ CAVITY COMBINATION

TECHNICAL FIELD

This invention relates to the electrical connectors having cavities for receiving electrical terminals therein.

BACKGROUND OF THE INVENTION

Current electrical connection systems have many disadvantages. These types of systems are known to include first and second connector housings having a plurality of terminal cavities formed therein. The connector housings have an opening in a rear face for insertion of a metal terminal with a wire attached. The housing usually includes complicated locking mechanisms for securing to mating lock features on the metal terminal. The housings are molded utilizing complicated and expensive tooling and the metal terminals are formed with equally complex stamping and folding operations. Further, insertion of individual terminals into such housing cavities is a tedious and expensive task.

The present invention provides advantages over and alternatives to the prior art.

SUMMARY OF THE INVENTION

The invention includes an electrical connection system utilizing a terminal/cavity combination. The system includes a connector housing having a bay for receiving a plurality of the terminal/cavity combination units in a stacked relationship. The terminal/cavity combination unit includes a metal terminal, preferably having a tuning fork configuration, that is received in an electrically insulative carrier. The insulative carrier has a terminal cavity defined in part by two spaced apart side walls and a floor extending between the side walls for supporting the terminal. The carrier also includes a front wall having an opening for receiving a portion of a second terminal therethrough and so that the second terminal makes electrical contact with the terminal in the carrier. At least one indexing rail extends downwardly from a portion of the floor. Carriers can be stacked one on top of the other wherein the rail or rails are received between the two spaced apart walls of the carrier below. A plurality of terminal/cavity combination units in the stacked relationship are then inserted into the bay of the connector housing. Simple mating lock features on the terminal/cavity combination unit and the housing keep the units in place.

These and other objects, features and advantages of the present invention will become apparent from the following brief description of the drawings, detailed description and appended claims and drawings.

DESCRIPTION OF THE PREFERRED EMBODIMENT

Figure 2:
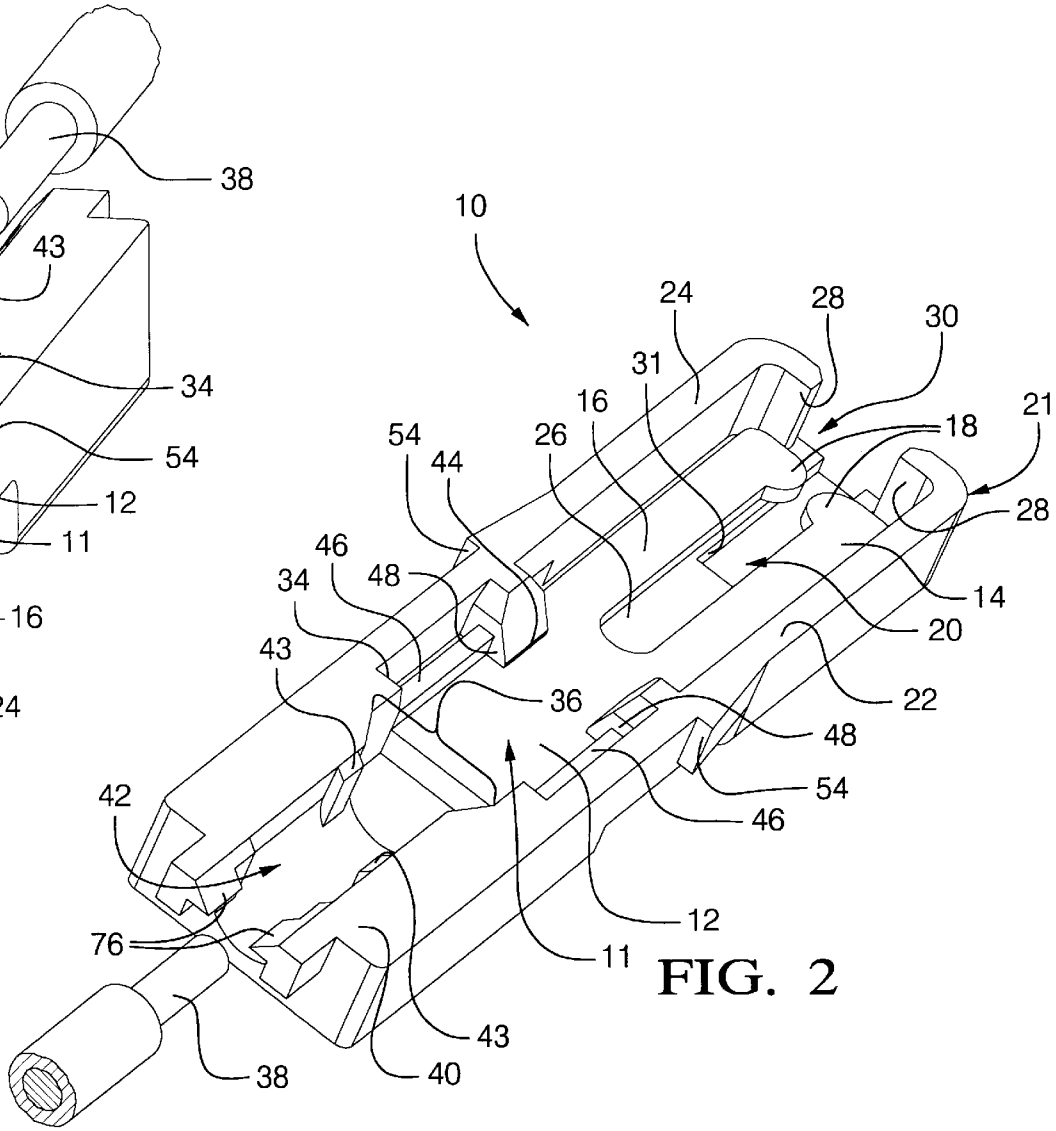
FIG. 2 is a perspective view of a terminal/cavity combination unit showing terminal and cable insulation locking features according to the present invention.
Figure 1:
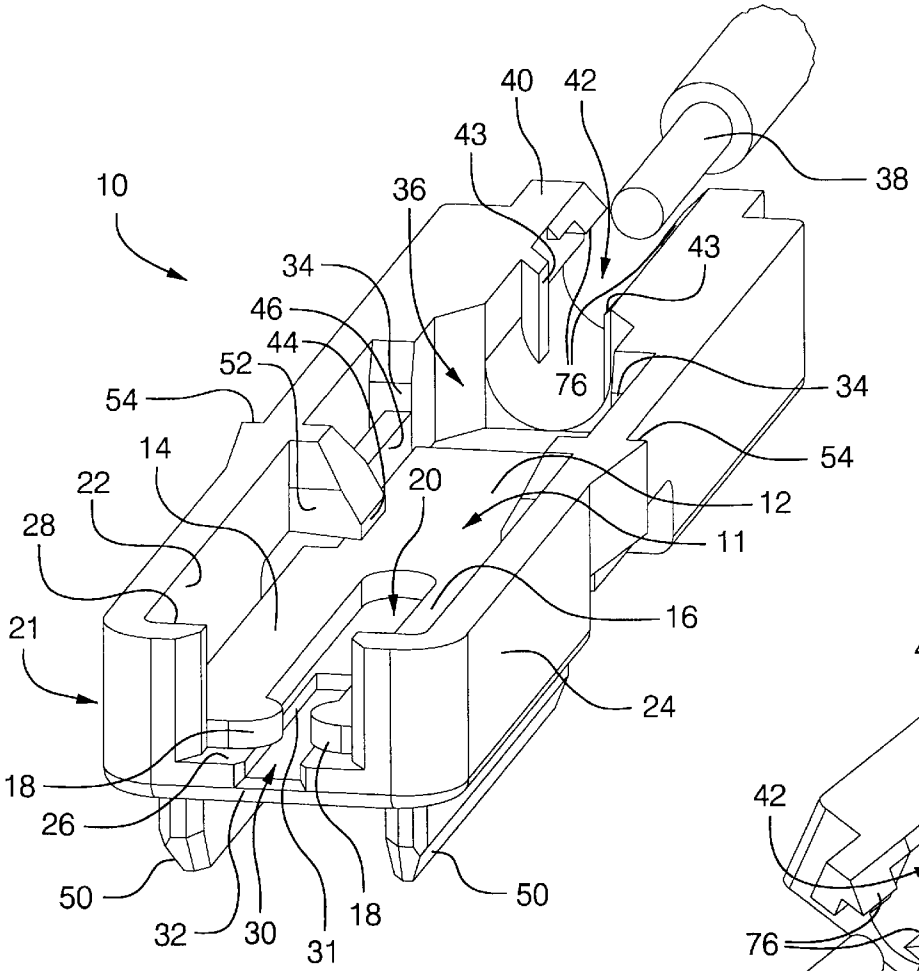
FIG. 1 is a perspective view of a terminal/cavity combination unit including indexing rails for nesting carriers according to the present invention.

FIGS. 1–2 illustrate a terminal/cavity combination unit 10 including a terminal 11 having a tuning fork configuration including a core body 12 and a pair of spaced apart contact beams 14, 16 extending from one end of the core body 12. Preferably each contact beam 14, 16 includes a nub 18 for engaging another terminal positioned in a slot 20 defined by the beams 14, 16. The terminal 11 is received in a carrier 21 having a cavity defined in part by two spaced apart upright walls 22, 24 and a floor 26 extending between the walls 22, 24 for supporting the terminal 11. Preferably the carrier 21 includes a front wall 28 having an opening 30 formed therein for receiving a portion of another terminal. A bridge 32 may be provided underneath the opening 30 and extending between the side walls 22, 24 for guiding the other terminal. The floor may have a recess, aperture, slot or groove 31 formed therein to receive a portion of the other terminal.

Figure 3:
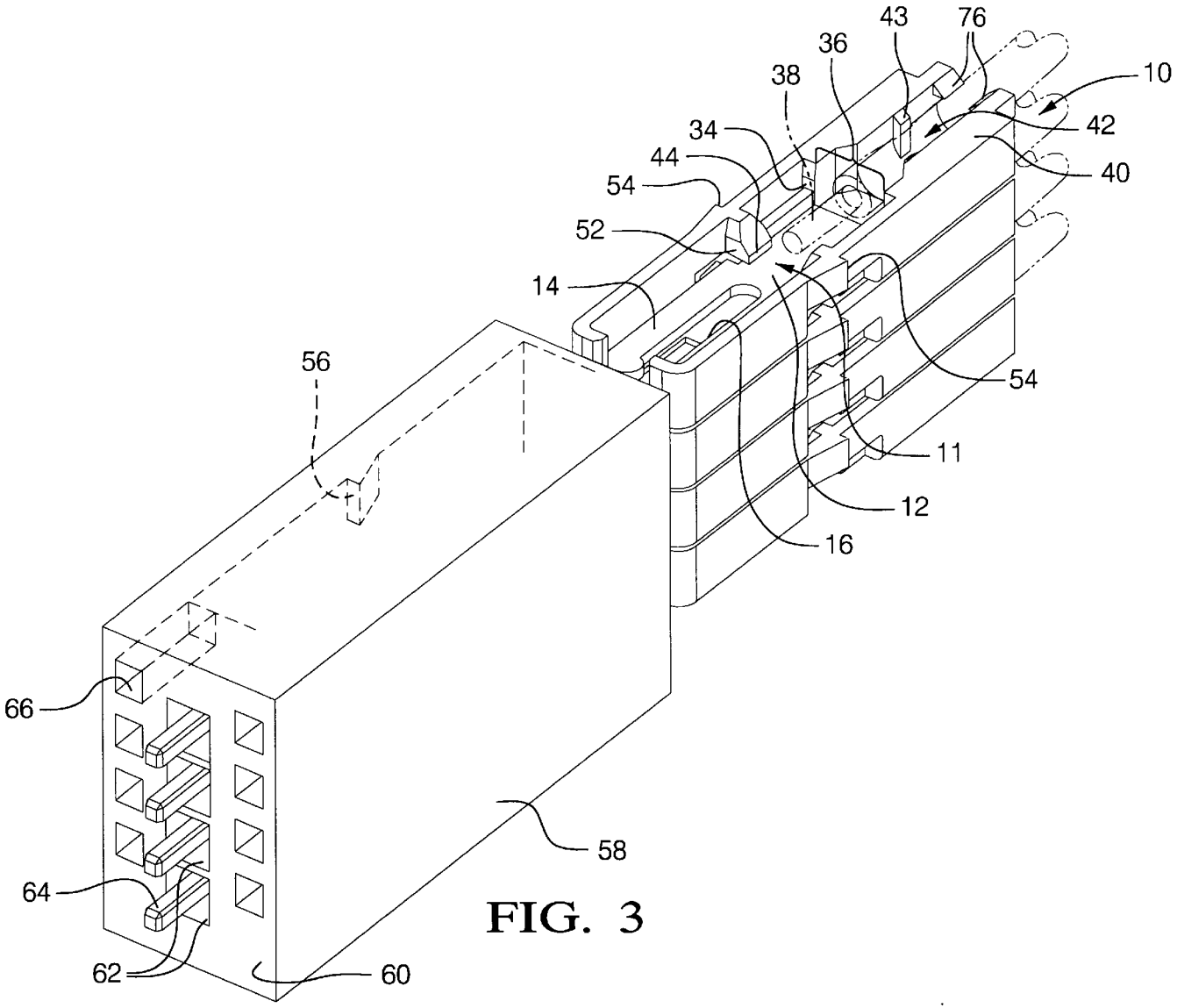
FIG. 3 is a partially exploded perspective view of a connector housing for receiving terminal/cavity combination units in a stacked relationship according to the present invention, as viewed from a rear face.

Preferably the carrier includes a rear wall 34 also having an opening 36 therein for receiving a wire cable 38 therethrough (FIG. 3). Referring again to FIGS. 2–3, adjacent the rear wall 34 is a cable mounting portion 40 having a channel 42 defined therein for receiving a portion of the cable. Forward insulation gripper teeth 43 and aft insulation gripper teeth 76 extend from the mounting portion into the channel 42 for engaging the insulation of the cable and securely holding the cable in position. The bare wire of the cable may be sonically welded to the core body portion 12 of the terminal or affixed thereto by a variety of other means such as soldering.

Referring again to FIGS. 1–2, preferably terminal locking features 44 such as a chamfered ramp extend inwardly from each side wall 22, 24 of the carrier 21. The side walls 22, 24 are flexible and can be moved in a transverse direction to the longitudinal axis of the carrier 21 so that the terminal 11 can be snap-fit into the carrier 21 and held in position between the locking feature 44 and the floor 26. Preferably the terminal 11 includes wings 46 that are bent upward and received between a rear face 48 of a locking feature 44 and the rear wall 34 to prevent axial movement of the terminal.

Referring to FIGS. 1–3, indexing rails 50 extend downwardly from the floor 26 and are constructed and arranged to be received and nested inside the side walls 22, 24 and between the front wall 28 and a front face 52 of a locking feature 44 of a carrier positioned below. Preferably each carrier 21 includes an outwardly extending shoulder 54 formed on the outside surface of each wall 22, 24 for locking against a sloped shoulder 56 defined in a connector housing 58 as shown in FIG. 3. When the carriers 21 are inserted in the housing 58 the carrier shoulder 54 engages the housing shoulder 56 causing the wall 22, 24 to flex inward and then snap back after the housing shoulder 56 has passed the carrier shoulder 54, to lock the carrier in place.

As shown in FIG. 3, the connector housing 58 has a front face 60 having a plurality of terminal openings 62 each for receiving a portion of another terminal such as a square pin 64 that is also engaged by the beams 14, 16 of the tuning fork terminal 11. The front face 60 may also include a plurality of lock access openings 66 to allow access to the lock features 56, 54 and removal of the terminal/cavity combination unit 10 from the housing 58.

Figure 4:
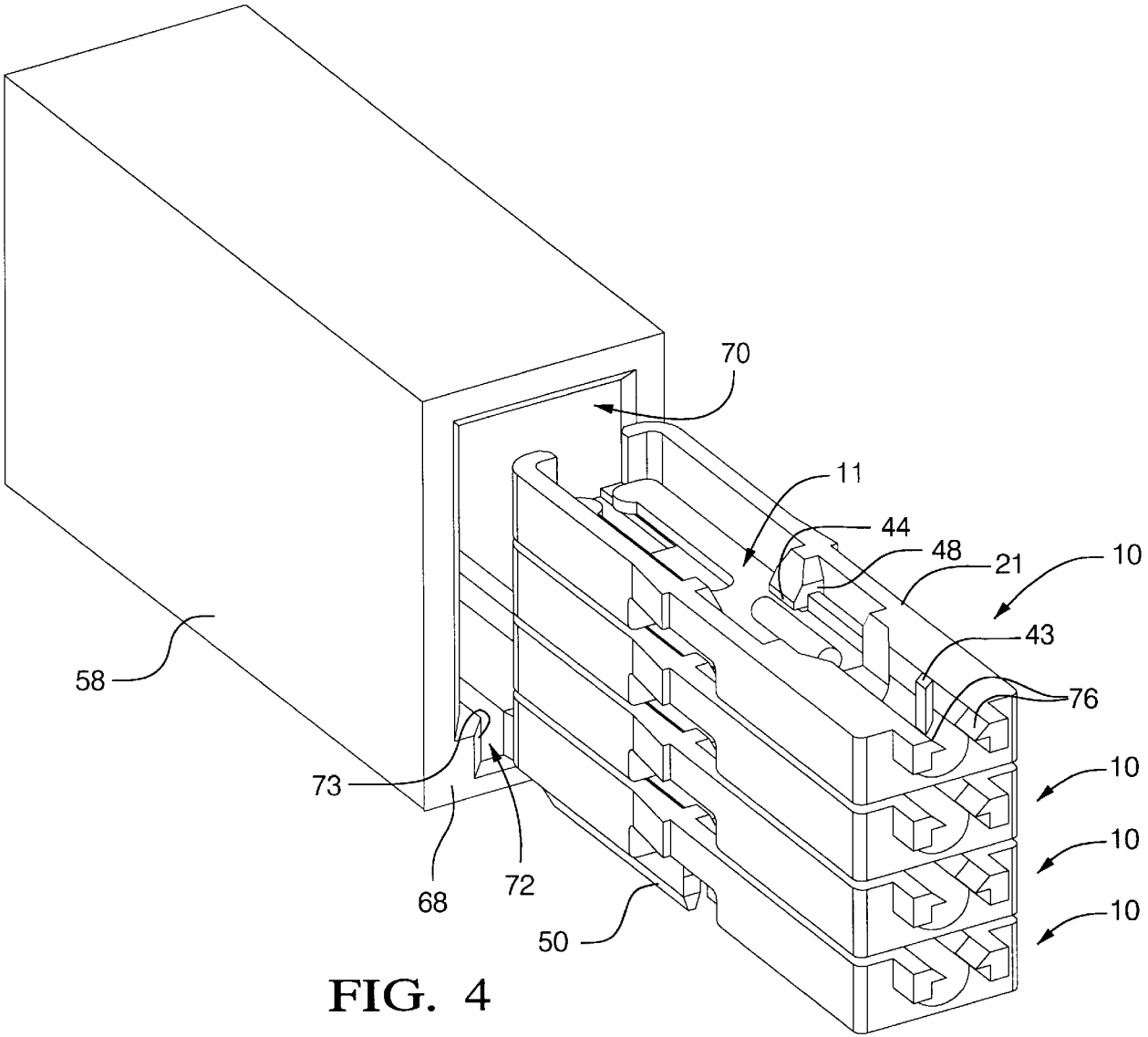
FIG. 4 is an exploded view of a connection system having a housing, and terminal/cavity combination units in a stackable relationship according to the present invention, as viewed from a front face.

FIG. 4 shows the housing 58 having a rear face 68 and a bay opening 70 formed therein for receiving the plurality of terminal/cavity combination units 10 in a stacked relationship. The bay opening 70 includes an indexing rail channel 72 for receiving and guiding each of the indexing rails 50 on the lower terminal/cavity combination unit 10 of the stack. The housing walls 73 defining the indexing rail channels 72 also prevent the stacked units 10 from moving from side to side.

The present invention has many advantages over the prior art. The use of the carriers 21 makes it possible to utilize very thin gauge connection terminals and at the same time makes the assembly much easier and cost effective. Further, the delicate terminal is protected by the carrier during the handling and sonic welding operations. The terminal/cavity combination unit makes assembly easier because the piece is much larger and easier to handle than prior art plug-in terminal pieces. The terminal/cavity combination units are stackable allowing for automated or manual loading of the connector housing. The units are also nested to maintain perfect terminal alignment. The unit greatly decreases the complexity of the tooling needed to manufacture both the connector housing and the terminal. Finally, the configuration of the terminal/cavity combination units allows the units to be used in variety of housing configurations.

We claim:

1. A product comprising:

a plurality of terminal/cavity combination units, each of said units comprising an electrically insulative carrier and a metal terminal received in the carrier, the carrier including an indexing rail for nesting in an adjacent carrier, the plurality of terminal/cavity combination units being received in a connector housing in a stacked relationship.

2. A product as set forth in claim 1 wherein said carrier further comprises a pair of spaced apart side walls and a floor extending between the side walls for supporting the terminal, and wherein the indexing rail is received between the side walls of an underlying carrier.

3. A product comprising:

a connector housing having a rear face with a bay opening formed therein communicating with a bay defined in the connector housing, the bay opening including an indexing rail channel at a lower end thereof, a plurality of terminal/cavity combination units each unit comprising an electrically insulative carrier and a metal terminal received in the carrier, the metal terminal having a tuning fork configuration, the carrier further comprising a pair of spaced apart upright walls having an opening between the side walls for receiving the terminal laterally and a floor extending between the upright walls for supporting the terminal, a pair of spaced apart indexing rails extending downwardly from the floor for nesting between the side walls of an underlying carrier or for being received in the index channel formed in the housing.

4. A product as set forth in claim 3 wherein the carrier further comprises a cable mounting portion for holding a wire cable in a position where the wire cable can be affixed to the terminal.

5. A product as set forth in claim 3 wherein the side walls include a terminal locking projection on an inside face and the side walls flex in a transverse direction to the longitudinal axis of the carrier so that the terminal can be pushed passed the locking projections and thereafter the projections lock the terminal against the floor.

6. A product as set forth in claim 5 further comprising a shoulder on an outer face of each carrier wall lockable against a mating shoulder in the housing.

7. A product as set forth in claim 5 wherein the carrier further comprises a rear wall adjacent each side wall and wherein the terminal includes opposed bent up wings between the respective locking projections of the side walls and the rear wall of the carrier to lock the terminal in a longitudinal direction.

8. A product as set forth in claim 3 further comprising a front face on the housing having a terminal opening, and an unlocking tool access opening extending to the position of the shoulder on the outside face of the side wall so that the side wall can be pushed inwardly allowing the side wall shoulder to be moved passed the housing shoulder and the unit removed from the housing.

9. A product comprising:

a plurality of terminal/cavity combination units, each of said units comprising an electrically insulative carrier and a metal terminal received in a cavity of the carrier, the cavity having spaced apart side walls with an opening between the side walls for receiving the terminal laterally and a floor extending between the side walls to support the terminal, the carrier including an indexing rail for nesting in an underlying carrier, the indexing rail being received between the side walls of an underlying carrier through the opening of the underlying carrier, and the plurality of terminal/cavity combination units being received in a connector housing in a stacked relationship.

* * * * *